US007302061B2

(12) United States Patent
Rivera

(10) Patent No.: US 7,302,061 B2
(45) Date of Patent: Nov. 27, 2007

(54) DUAL-TWEETER LOUDSPEAKER

(75) Inventor: Dean M. Rivera, Chula Vista, CA (US)

(73) Assignee: KSC Industries Incorporated, Chula Vista, CA (US)

( * ) Notice: Subject to any disclaimer, the term of this patent is extended or adjusted under 35 U.S.C. 154(b) by 741 days.

(21) Appl. No.: 10/319,388

(22) Filed: Dec. 12, 2002

(65) Prior Publication Data

US 2003/0142844 A1 Jul. 31, 2003

Related U.S. Application Data

(63) Continuation-in-part of application No. 29/150,355, filed on Nov. 21, 2001, now Pat. No. Des. 476,313.

(51) Int. Cl.
*H04R 5/00* (2006.01)

(52) U.S. Cl. ..... 381/1; 381/300; 381/386

(58) Field of Classification Search ..... 381/1, 381/300, 337, 386, 150, 332, 335; D14/204, D14/216, 224
See application file for complete search history.

(56) References Cited

U.S. PATENT DOCUMENTS 2,857,478 A * 10/1958 Harris ..... 381/182
4,249,037 A 2/1981 Dexter
4,554,414 A * 11/1985 House ..... 381/182
4,811,406 A * 3/1989 Kawachi ..... 381/186
5,119,429 A 6/1992 Chatelain
5,123,500 A 6/1992 Malhoit et al.
5,181,253 A * 1/1993 Jordan ..... 381/184
5,307,418 A 4/1994 Sumitani
5,657,392 A 8/1997 Bouchard
6,026,927 A * 2/2000 Burdett et al. ..... 181/144
6,031,920 A 2/2000 Wiener
6,279,678 B1 * 8/2001 Tracy ..... 181/144

OTHER PUBLICATIONS http://www.radioshack.com/product.asp?catalog%5Fname=CTLG&category%5Fname=CTLG%5F002%5F001%5F022%F000&product%Fid=40%2D4092, Dual-Tweeter, 6-1/2"Ceiling Mount Stereo Speaker, Radio Shack Brand, Model 40-4092.

* cited by examiner

*Primary Examiner*—Vivian Chin
*Assistant Examiner*—Con P. Tran
(74) *Attorney, Agent, or Firm*—Knobbe Martens Olson & Bear LLP

(57) ABSTRACT

A dual tweeter speaker, wherein the tweeters are spaced far apart, is provided. The loudspeaker system includes a woofer and two tweeters, which are arranged so they reduce interference with sound waves emitted by the woofer. The spaced apart tweeters provide an improved stereo imaging range. The tweeters can also use a low cross-over frequency, so that they can provide both midrange and high frequencies.

18 Claims, 16 Drawing Sheets

DUAL-TWEETER LOUDSPEAKER

RELATED APPLICATIONS

This application is a continuation-in-part of U.S. patent application Ser. No. 29/150,355, filed on Nov. 21, 2001 now U.S. Pat. No. D476,313, which is hereby incorporated by reference.

BACKGROUND OF THE INVENTION

1. Field of the Invention

The present invention relates to stereo systems and, in particular, to a dual-tweeter loudspeaker.

2. Description of the Related Art

Traditionally, stereo dual-tweeter, in-ceiling loudspeakers have been designed and manufactured with two tweeters positioned side-by-side mounted on a post or on a bridge. These traditional speakers may also include a woofer. In both the post and bridge configurations, the tweeters are located over the center of the woofer voice coil and positioned so that the tweeters do not impair the movement of the woofer cone, which can result in dips and peaks in the frequency response. Occasionally, the tweeters will be angled outward in an attempt to improve the stereo imaging effect.

In some designs, the woofer uses a dual voice coil that is wired to terminals that accept signals from both the left and right amplifier channels. When the two signals are connected to the dual voice coil, they are mutually combined and the signals are converted to mechanical energy to produce sound from the woofer. Low frequency energy, primarily because of the long wavelengths, is difficult to localize. Therefore, a stereo effect is perceived from these low frequencies.

Monaural refers to a system where the audio signals are mixed together and routed through a single audio channel. Monaural systems can have multiple loudspeakers, and even multiple widely separated loudspeakers. The stereo signal contains arrival time and phase information that replicates or simulates directional cues found in the original performance. True stereophonic sound systems have two independent audio signal channels, and the signals that are reproduced by the system have a specific level and phase relationship to each other. The desired result when the source information is played back through a loudspeaker system is a reproduction of the original live performance.

A stereo system should also have equal coverage of both the left and right channels, at essentially equal levels. With proper positioning of the loudspeakers, output level and signal arrival time differences between the two loudspeakers are minimal, thus preserving the stereo image and localization characteristics of the original performance, but only within a certain range. Outside that range, the image collapses and only one of the channels can be heard.

Other characteristics that are important when replicating a stereo image from two loudspeakers include uniform coverage over the entire listening area, and a minimal level of phase response difference between the two speakers for each channel's coverage over the listening area.

Therefore, there exists a need for an improved stereo dual-tweeter loudspeaker and particularly for a dual-tweeter loudspeaker which improves the stereo imaging of the speaker system.

SUMMARY OF THE INVENTION

In accordance with one embodiment of the present invention, a stereo speaker system is provided. The stereo speaker system includes a woofer driver, and first and second tweeters. In some embodiments, the first and second tweeters are positioned at diametrically opposite ends of the speaker system. The first and second tweeters can be adapted to reduce interference with sound waves emitted by the woofer driver.

In some embodiments, the first and second tweeters are angularly adjustable. The tweeters can be angularly adjustable from about 0-50 degrees. The woofer driver can include a dust dome. In some embodiments, the speaker system is adapted for mounting in a ceiling, while in other embodiments, the speaker system is adapted for mounting in a wall.

In accordance with another embodiment of the present invention, a stereo speaker system is provided. The stereo speaker system includes a speaker having a mounting frame, wherein the mounting frame has an inner circumference and a center, and at least two tweeters mounted at the inner circumference of the mounting frame.

In some embodiments, the tweeters are positioned at diametrically opposite ends of the mounting frame. In certain embodiments, the tweeters are not both positioned on a diameter passing through the center of the speaker. These tweeters can be positioned within at least 45 degrees of each other with respect to the center of the speaker.

In accordance with another embodiment of the present invention, a 2-channel speaker adapted for an office paging system is provided. The speaker includes a woofer driver, and first and second tweeters positioned at diametrically opposite ends of the speaker.

In accordance with another embodiment of the present invention, a method of reproducing sound in a single speaker is provided. The method includes mounting a first tweeter on one side of a woofer and mounting a second tweeter on an opposite side of the woofer.

The systems and methods have several features, no single one of which is solely responsible for its desirable attributes. Without limiting the scope as expressed by the claims that follow, its more prominent features will now be discussed briefly. After considering this discussion, and particularly after reading the section entitled "Detailed Description of the Preferred Embodiments" one will understand how the features of the system and methods provide several advantages over traditional systems and methods.

DETAILED DESCRIPTION OF THE PREFERRED EMBODIMENTS

Embodiments of the invention will now be described with reference to the accompanying figures, wherein like numerals refer to like elements throughout. The terminology used in the description presented herein is not intended to be interpreted in any limited or restrictive manner simply because it is being utilized in conjunction with a detailed description of certain specific embodiments of the invention. Furthermore, embodiments of the invention may include several novel features, no single one of which is solely responsible for its desirable attributes or which is essential to practicing the inventions herein described.

In some prior art designs, the midrange frequencies produced by the woofer and the high frequencies produced by the tweeters are localized in an attempt to create the stereo image. Although the intent is to provide a stereo image, the close positioning of the two tweeters results in a monaural characteristic.

In present dual tweeter designs, it has been found that these monaural characteristics are caused by the close tweeter spacing, such that a stereo signal routed to two tweeters positioned in close proximity to one another yields little if any imaging.

Figure 1:
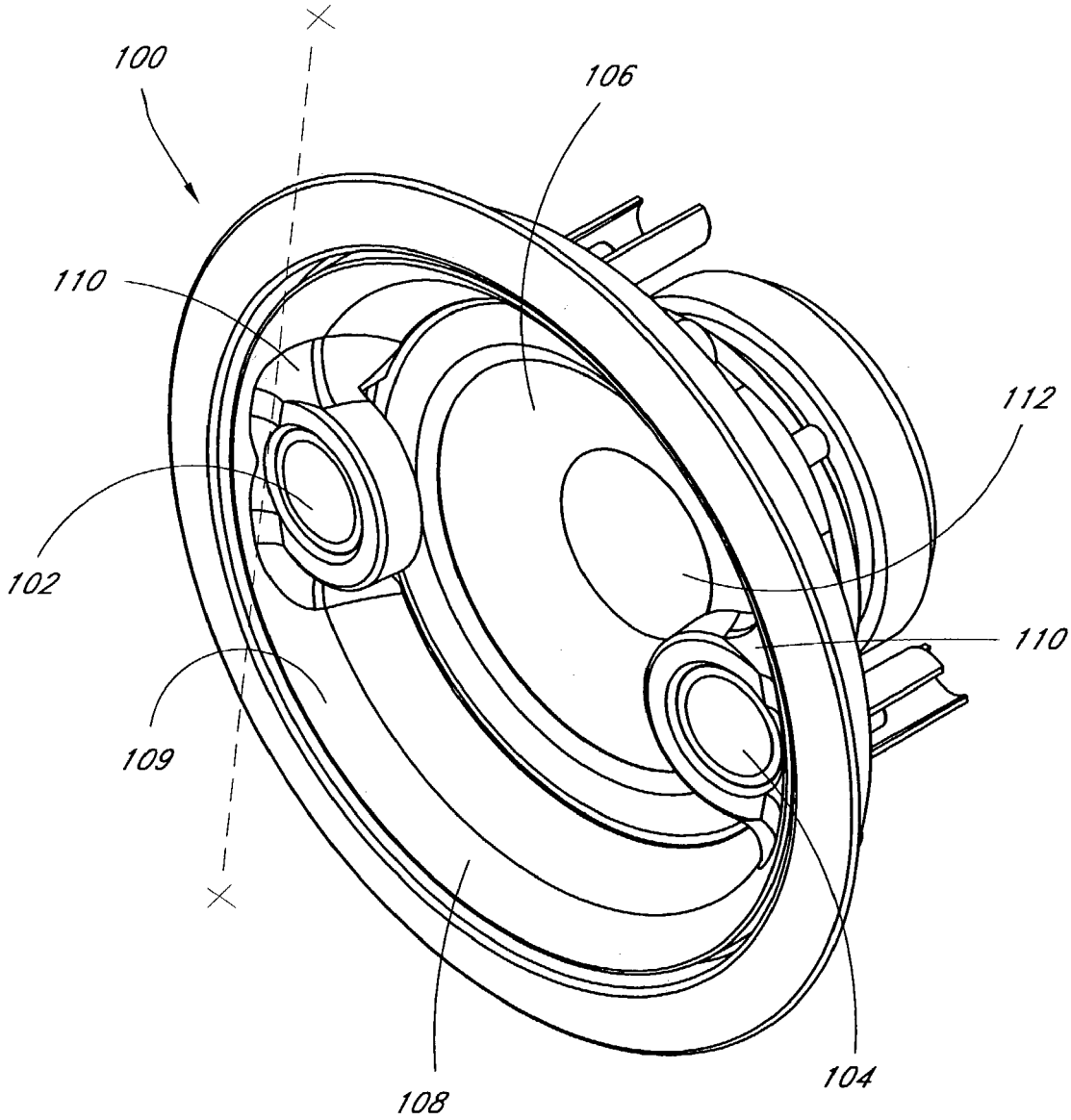
FIG. 1 is a perspective view of one embodiment of the stereo speaker design.
Figure 2A:
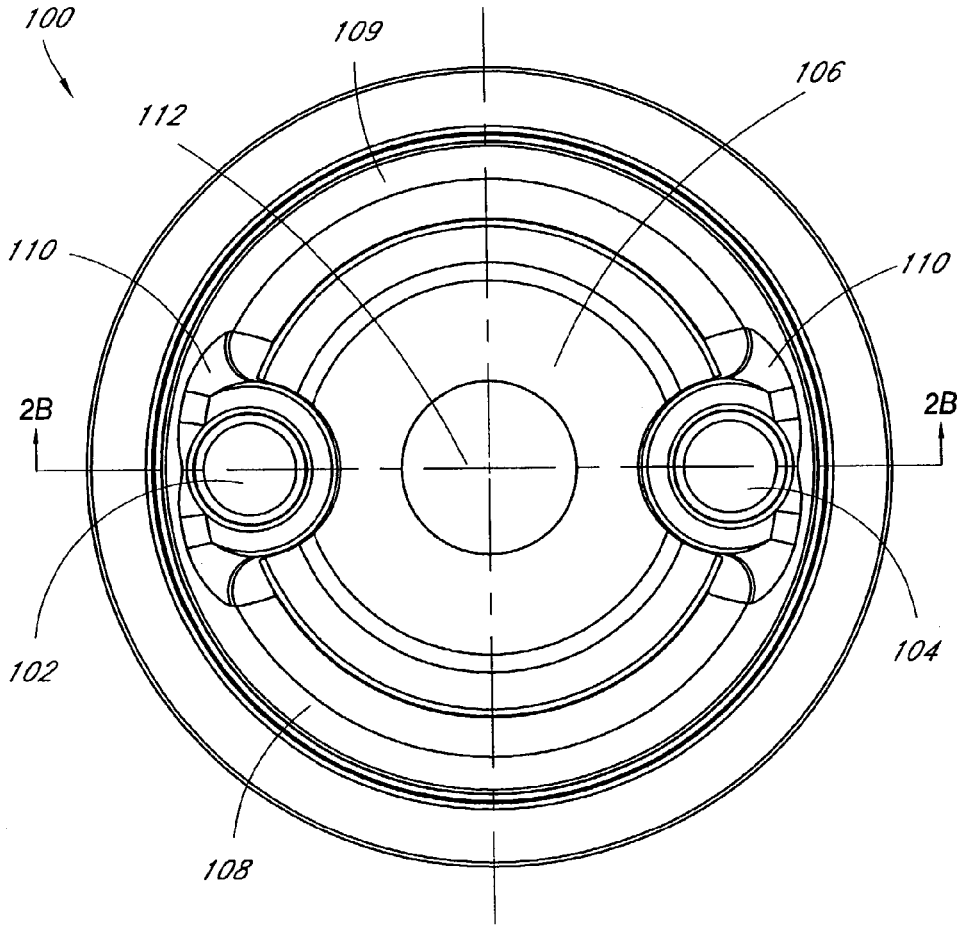
FIG. 2A is a front view of the stereo speaker design of FIG. 1.
Figure 2B:
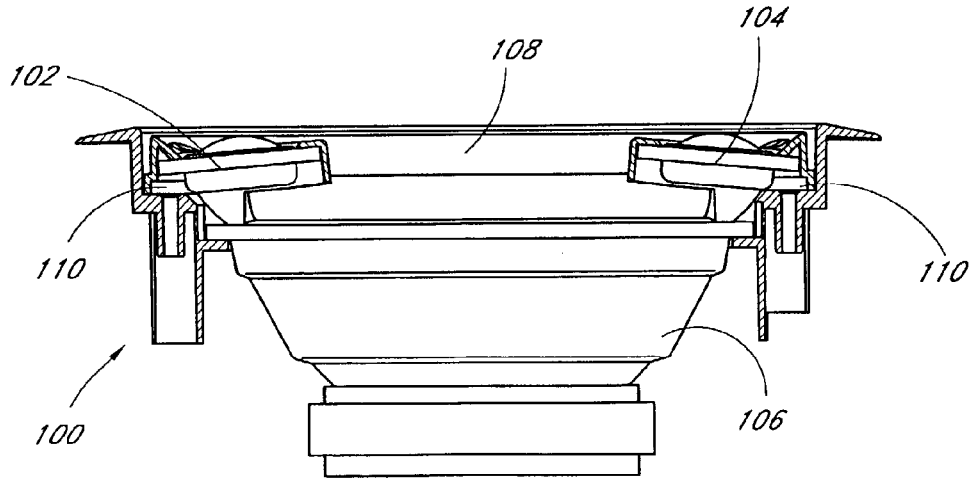
FIG. 2B is a partially cut away top view of the stereo speaker design of FIG. 1.
Figure 3:
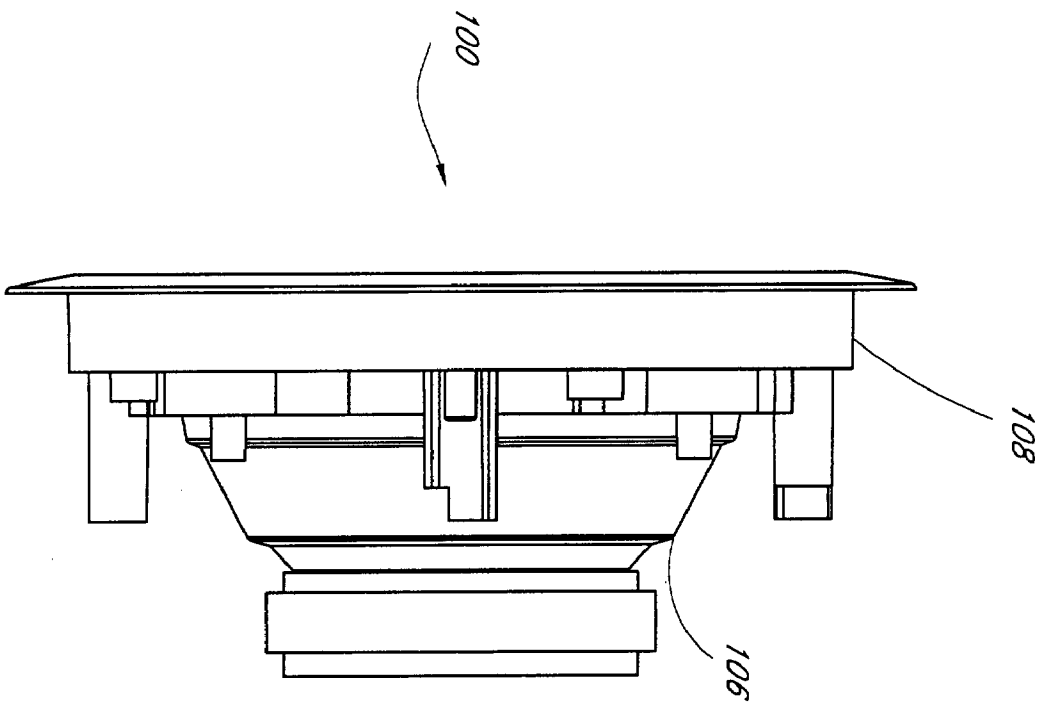
FIG. 3 is a side view of the stereo speaker design of FIG. 1.

Referring to FIGS. 1-3, a stereo speaker 100, including two tweeters 102, 104 and a driver 106 is shown. Speaker 100 is a dual-channel system. In some embodiments, the driver 106 is a woofer, although any driver which generally provides low- to mid-range frequencies can be used. The tweeters 102, 104 generally provide mid to high-range frequencies. Any tweeters which provide mid- to high-range frequencies or high range frequencies can be used. The speaker 100 also includes a mounting frame 108 generally defining an outer circumference of the speaker body. The mounting frame 108 includes an inner surface 109. The tweeters 102, 104 are positioned on the inner surface 109 of the mounting frame 108. Tweeters 102, 104 can be positioned on inner surface 109 using tweeter mounts 110, or tweeters 102, 104 can be integrally molded with the speaker 100 or otherwise constructed. In some embodiments the tweeters 102, 104 are positioned at diametrically opposite ends of the mounting frame 108. Any mounting frame which permits the positioning of tweeters 102, 104 on its inner surface can be used.

The tweeters 102, 104 can be angularly adjustable to further enhance the high frequency imaging. The tweeters 102, 104 can be adjusted up to about 50 degrees or more relative to a longitudinal axis X passing through the tweeter mount 110. In some embodiments, tweeters 102, 104 can swivel. In particular, as shown in FIG. 2B, tweeters 102, 104 can be adjusted to be angled outwardly.

In some embodiments, the tweeters 102, 104 are positioned as far apart as feasibly possible, which can be determined by the physical attributes of the boundaries of the speaker 100. By placing the tweeters 102, 104 on the mounting frame 108, they reduce the obstruction of the sound waves produced by the woofer driver 106, thereby reducing any interference with sound waves produced by the woofer driver 106.

Figure 4:
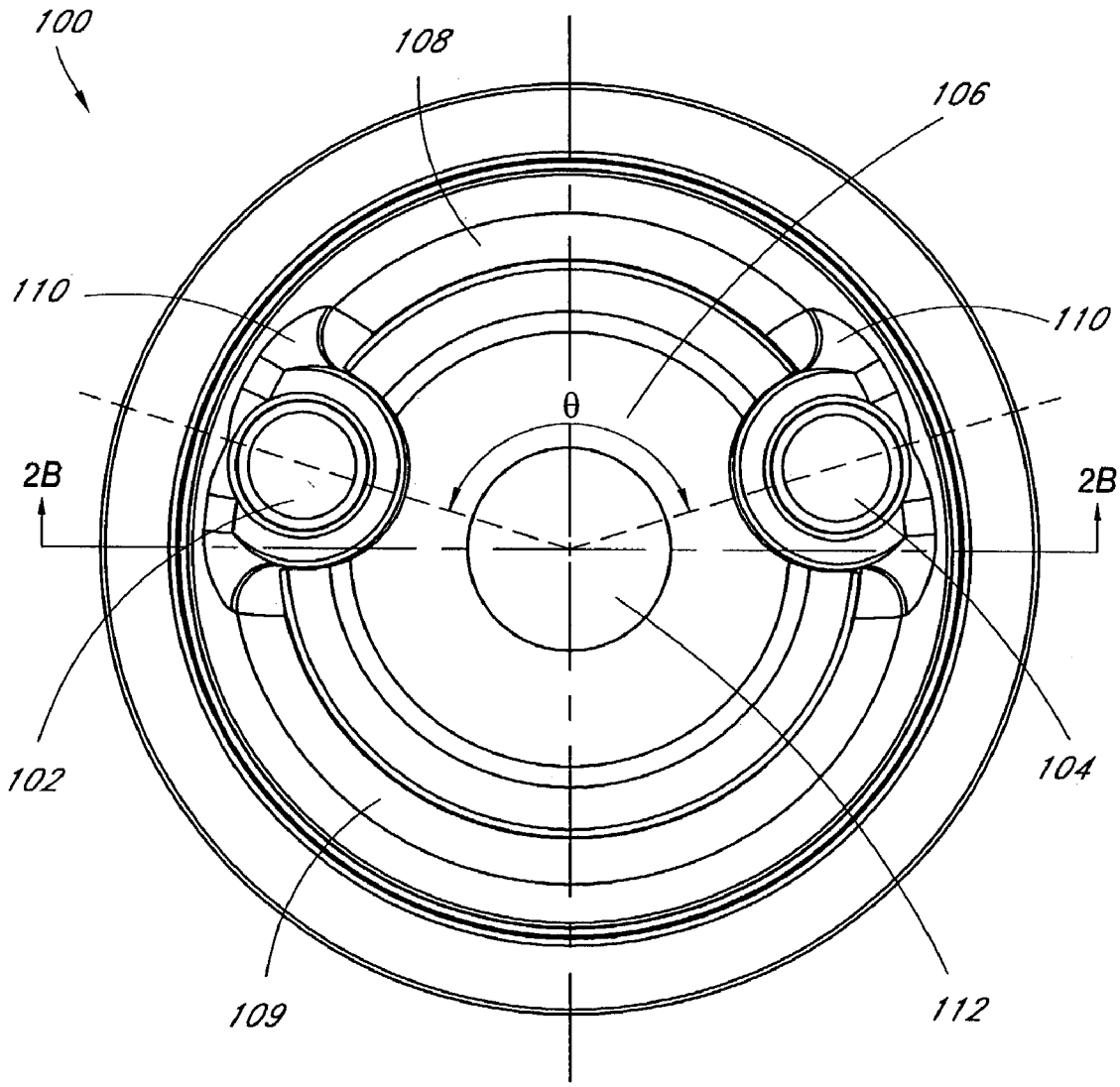
FIG. 4 is a front view of a stereo speaker of an alternative embodiment.
Figure 5:
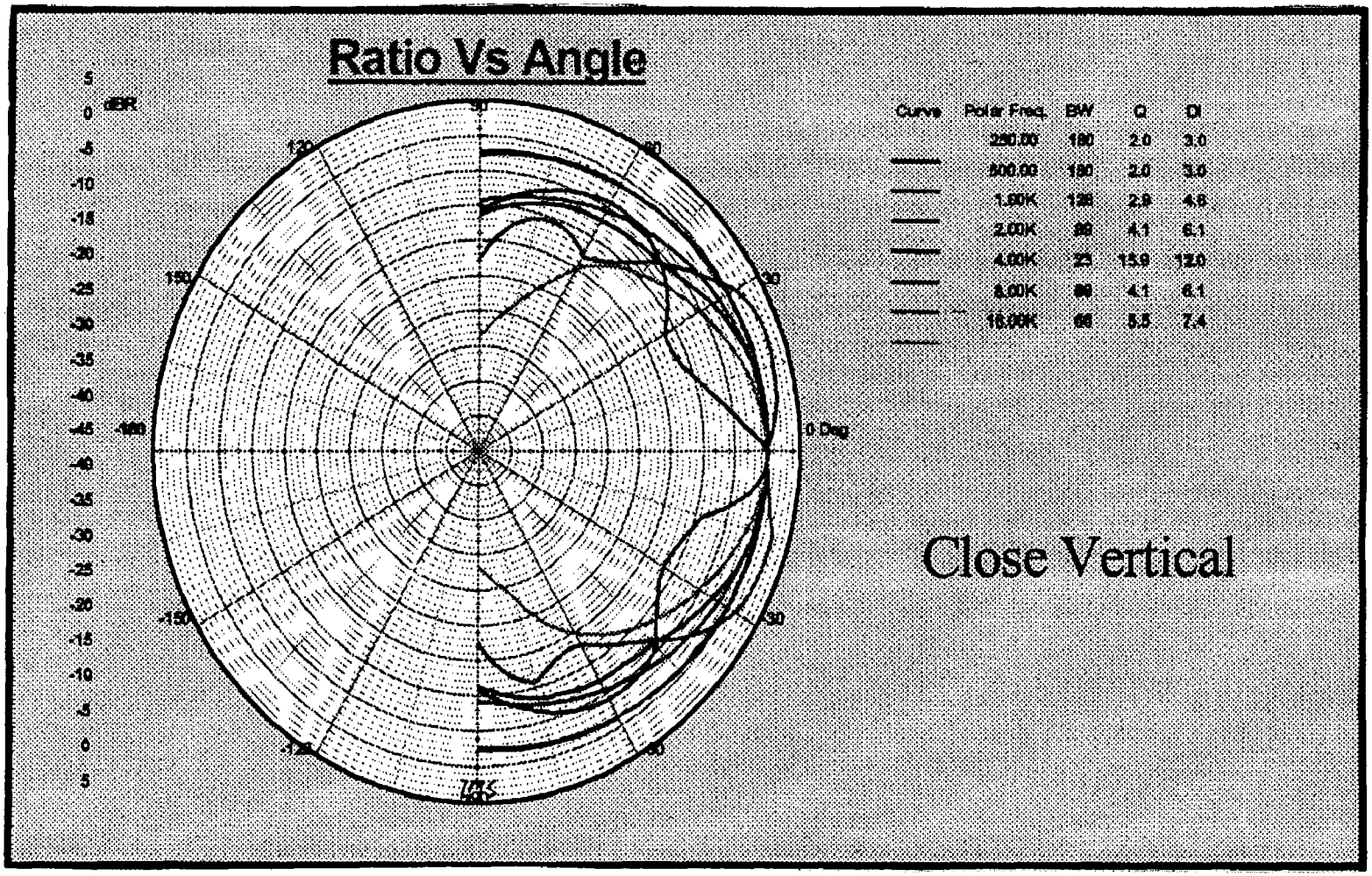
FIG. 5 is a graph comparing tweeters positioned close together in a vertical direction over a range of frequencies.
Figure 6:
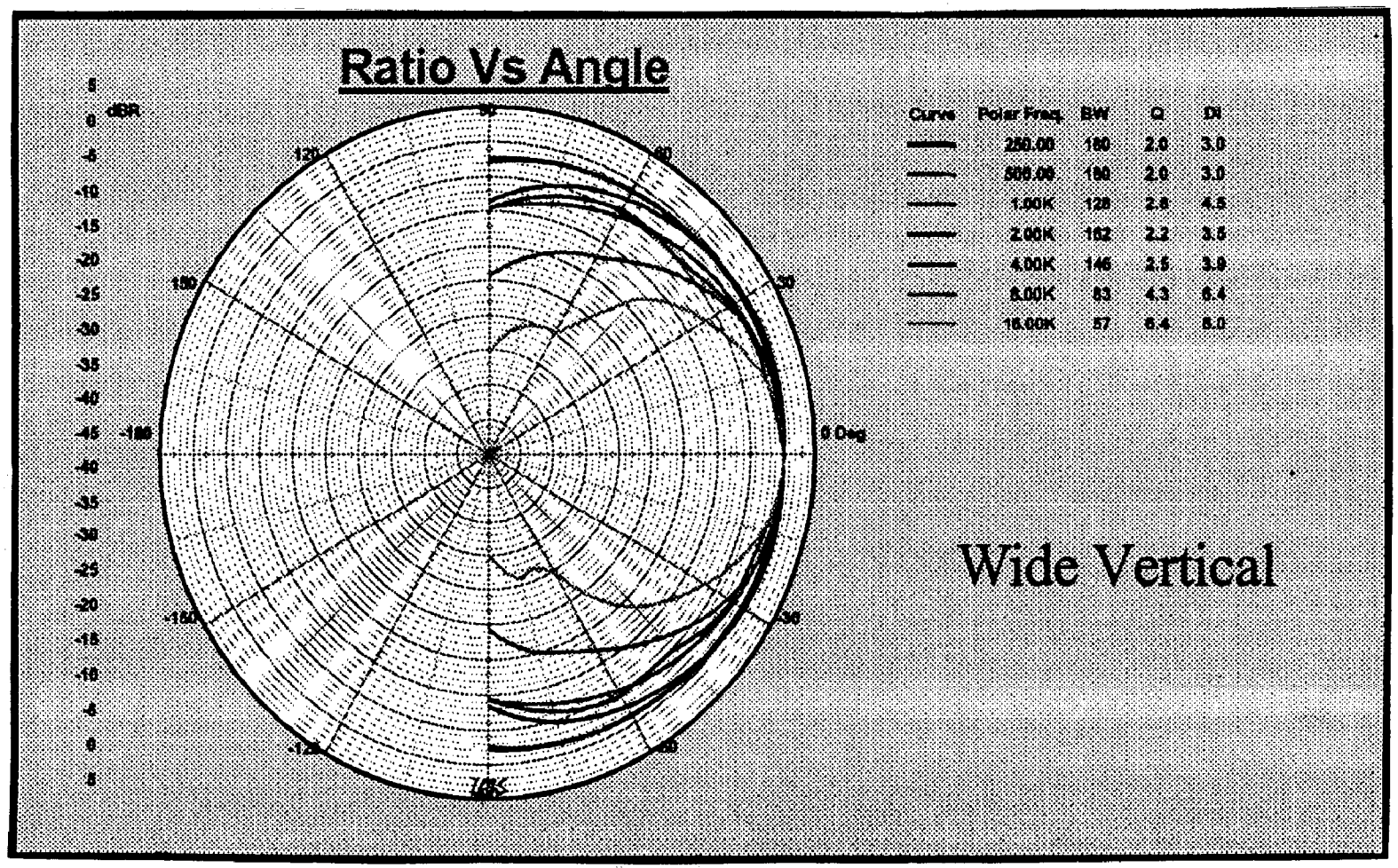
FIG. 6 is a graph comparing tweeters spread apart in a vertical direction over a range of frequencies.

Referring to FIG. 4, an alternative stereo speaker is shown. In some embodiments, the tweeters 102, 104 are positioned on the mounting frame 108 such that they are not positioned at diametrically opposite ends of the speaker 100. In some embodiments, they are positioned within at least 45 degrees of each other, relative to the center of the speaker 100.

In some embodiments, the woofer driver is covered with a dust dome 112, which enhances the sound quality by providing a smoother system frequency response. Any dust dome can be used. A stereo woofer with a dust dome can be used to timber-match with other in-wall loudspeakers that have dust domes that are part of a loudspeaker model line.

The speaker 100 is mounted in a ceiling in some embodiments, but can be mounted in a wall, in other embodiments.

Typical sizes of speaker 100 include but are not limited to, for example, 5, 5¼, 6, 6½, 8, 10, 12, 14, 15, and 18 -inches. It has been found that the greater the spacing between the tweeters 102, 104, the better the stereo imaging. The spacing is dimensionally determined by the size of the in-ceiling or in-wall frame. For example, a 6 -inch in-ceiling frame will have a closer spacing distance than an 8 -inch in-ceiling loudspeaker.

The stereo speaker 100 achieves better stereo imaging by increasing the distance between the tweeters 102, 104 and in some embodiments by also using the lowest crossover frequency allowable. The low crossover frequency ensures the tweeters will produce much of the upper midrange frequencies as well as the high frequencies, thereby ensuring that the midrange through high frequency information is produced by tweeters 102, 104 and the energy is physically separated. The tweeters 102, 104 are better able to reproduce such frequencies.

Furthermore, by positioning the tweeters 102, 104 farther apart, the center of the woofer driver 106 is not blocked by what would be a tweeter mounting post or housing.

In some embodiments, the speaker 100 is adapted to be used by itself. Rather than having separate speakers for the right and left channels, the speaker 100 may be configured as a dual-channel system providing both the left and right channels.

In some embodiments, the speaker 100 is adapted for use with public address systems. The speaker 100 is used as a stand-alone speaker in an office building, and is located in the wall or ceiling. Public address systems generally include a central telephone or message system, which transmits sound throughout an office to speakers. The speaker 100 provides improved sound in an office pager system. In some embodiments, speaker 100 can be placed in individual offices, or, in other embodiments, speaker 100 can be placed in various locations throughout a larger office area.

By analyzing the polar chart pattern of a loudspeaker, the characteristics that indicate good stereo imaging are viewable. The performance parameters visible in the polar chart pattern include bandwidth, directivity index, and directivity factor. This data is in the form of sound pressure level in relation to angle of measurement. A wide and smooth dispersion angle from a loudspeaker system generally shows good stereo imaging. The directivity index indicates how much louder in decibels the loudspeaker will play compared to an omni-directional source that radiates the same amount of power measured at the same distance. The measurements for directivity index and directivity factor are as follows:

$$DI=10\log(Q)$$

where Q is the directivity factor and is defined as:

$$Q=\frac{180}{\arcsin\left(\sin\left(\frac{\theta}{2}\right)\cdot\sin\left(\frac{\beta}{2}\right)\right)}$$

where θ is the Nominal horizontal coverage angle and β is the Nominal vertical coverage angle.

The directivity factor shows the directionality of the device. For example, direct sound radiators are classified as devices having a low directivity factor, while horns are classified as devices having a high directivity factor.

Figure 7:
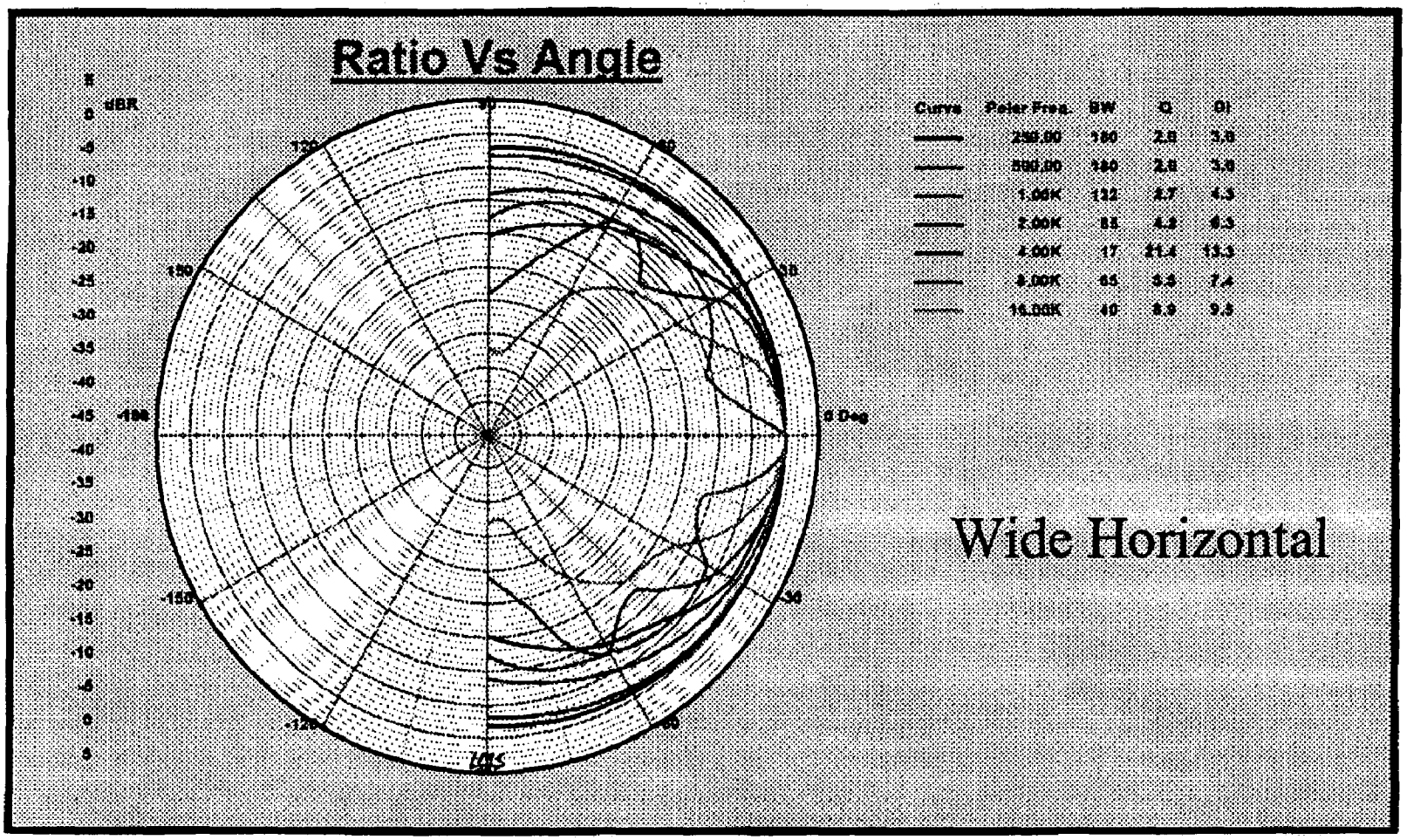
FIG. 7 is a graph comparing tweeters spread apart in a horizontal direction over a range of frequencies.
Figure 8:
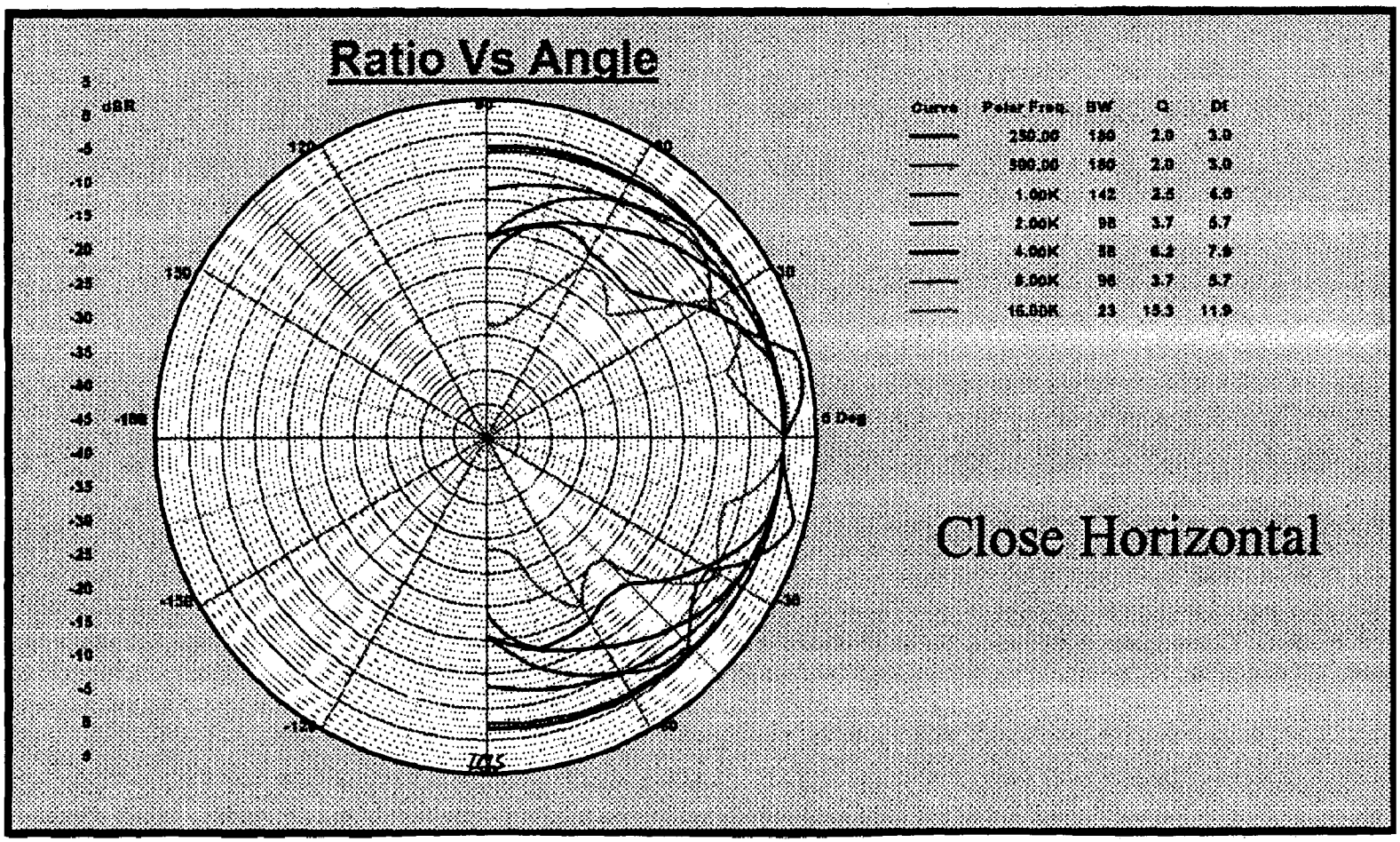
FIG. 8 is a graph comparing tweeters positioned close together in a horizontal direction over a range of frequencies.
Figure 9:
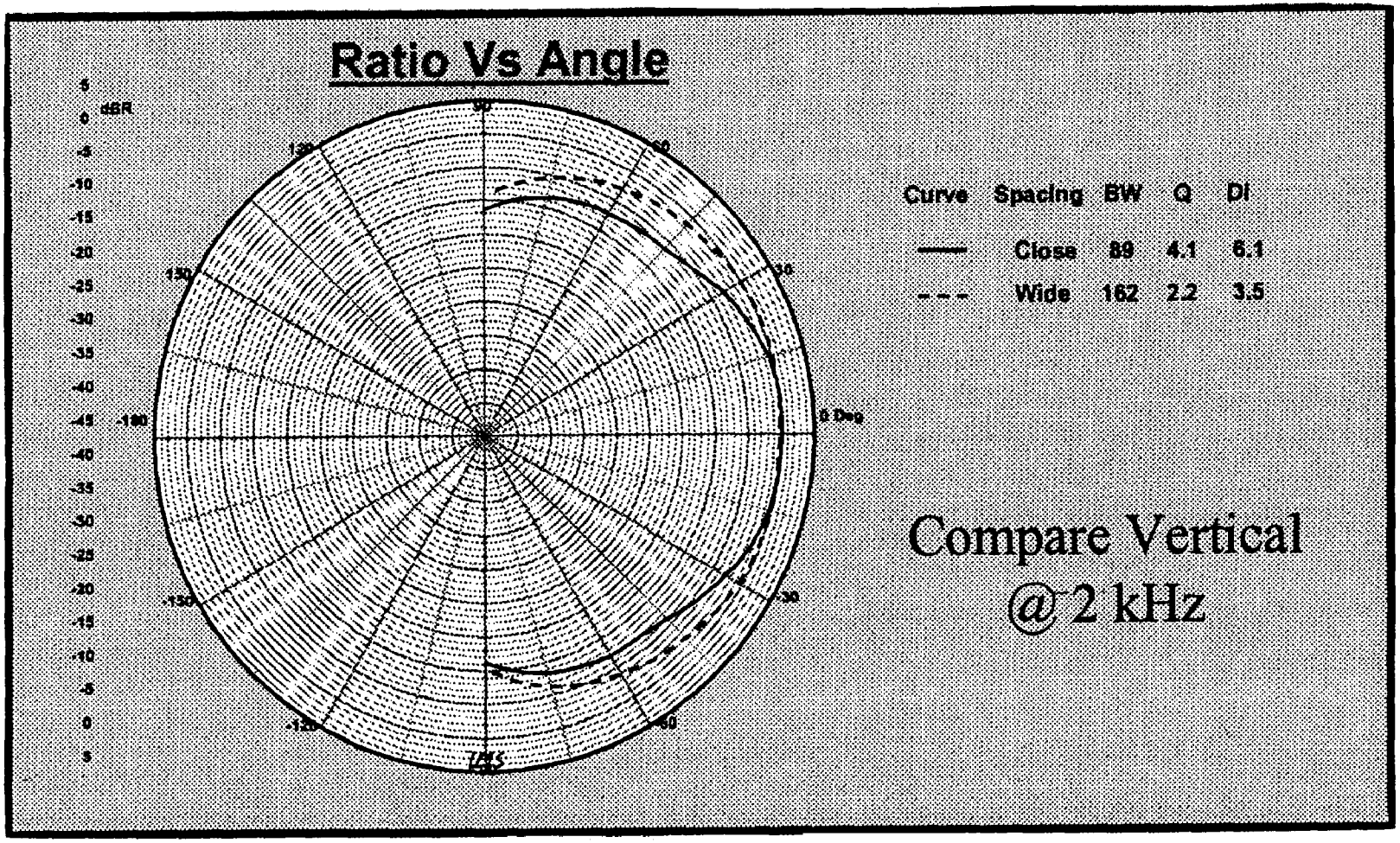
FIG. 9 is a graph comparing tweeters spread apart and tweeters positioned close together in a vertical direction at 2 kHz.
Figure 10:
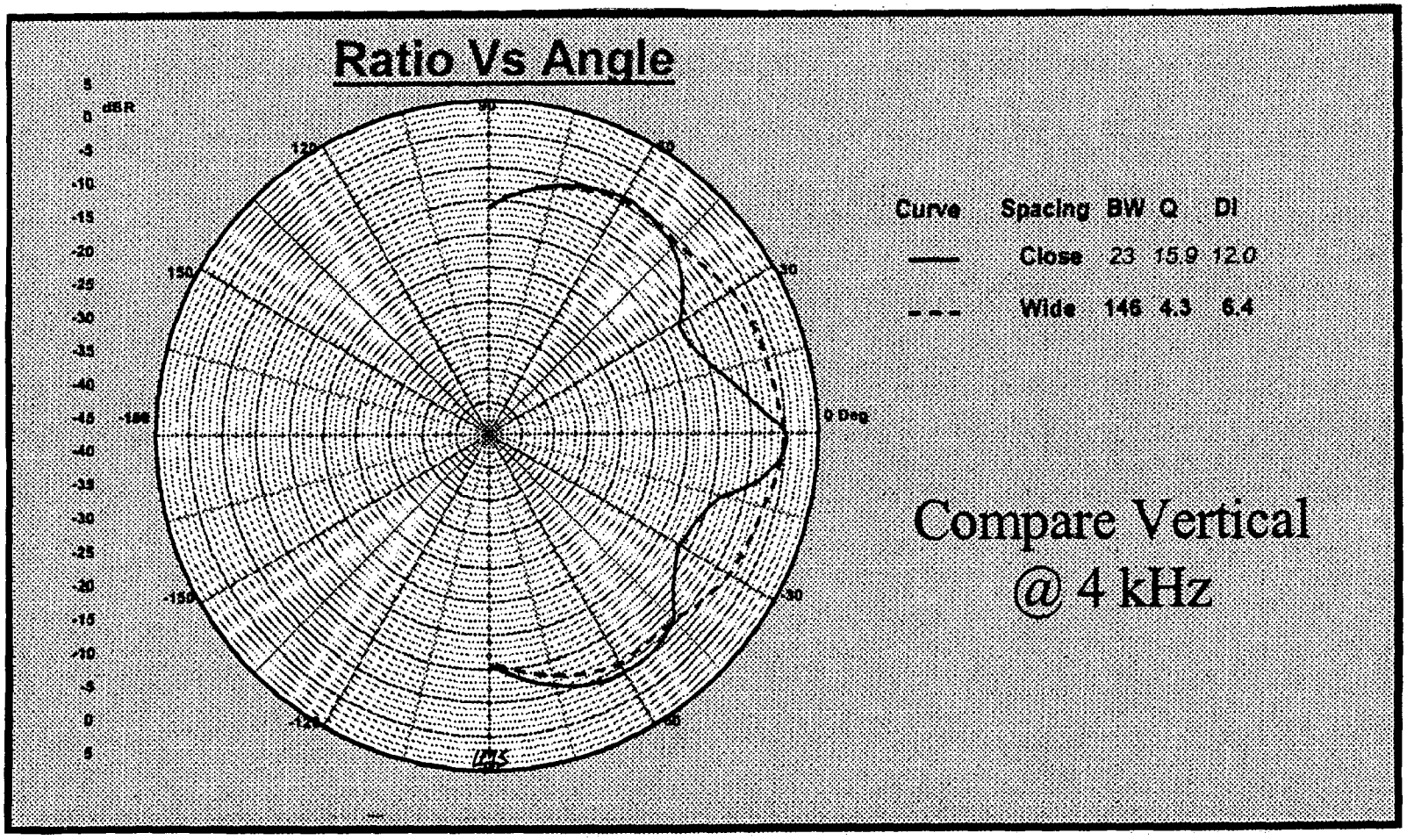
FIG. 10 is a graph comparing tweeters spread apart and tweeters positioned close together in a vertical direction at 4 kHz.
Figure 11:
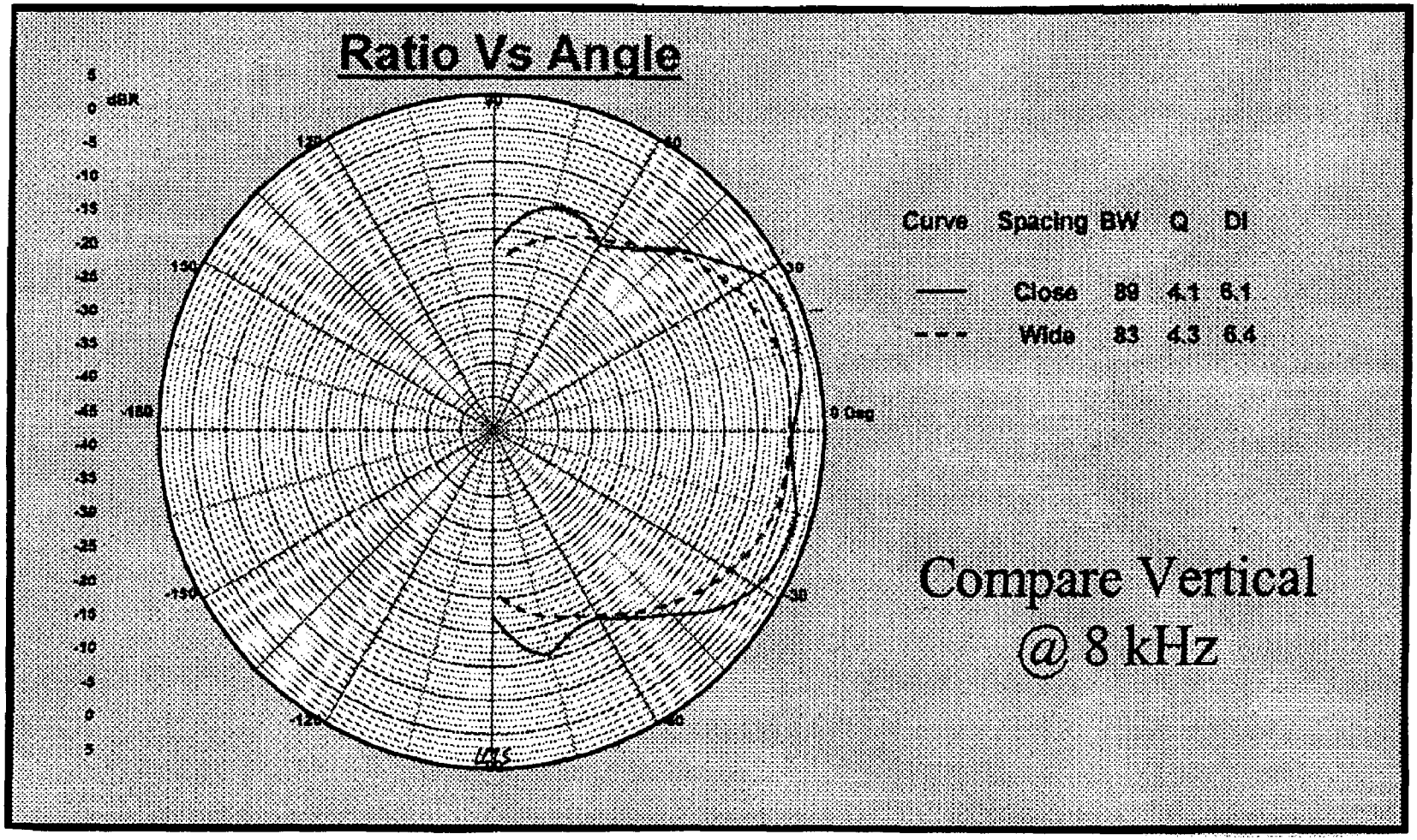
FIG. 11 is a graph comparing tweeters spread apart and tweeters positioned close together in a vertical direction at 8 kHz.
Figure 12:
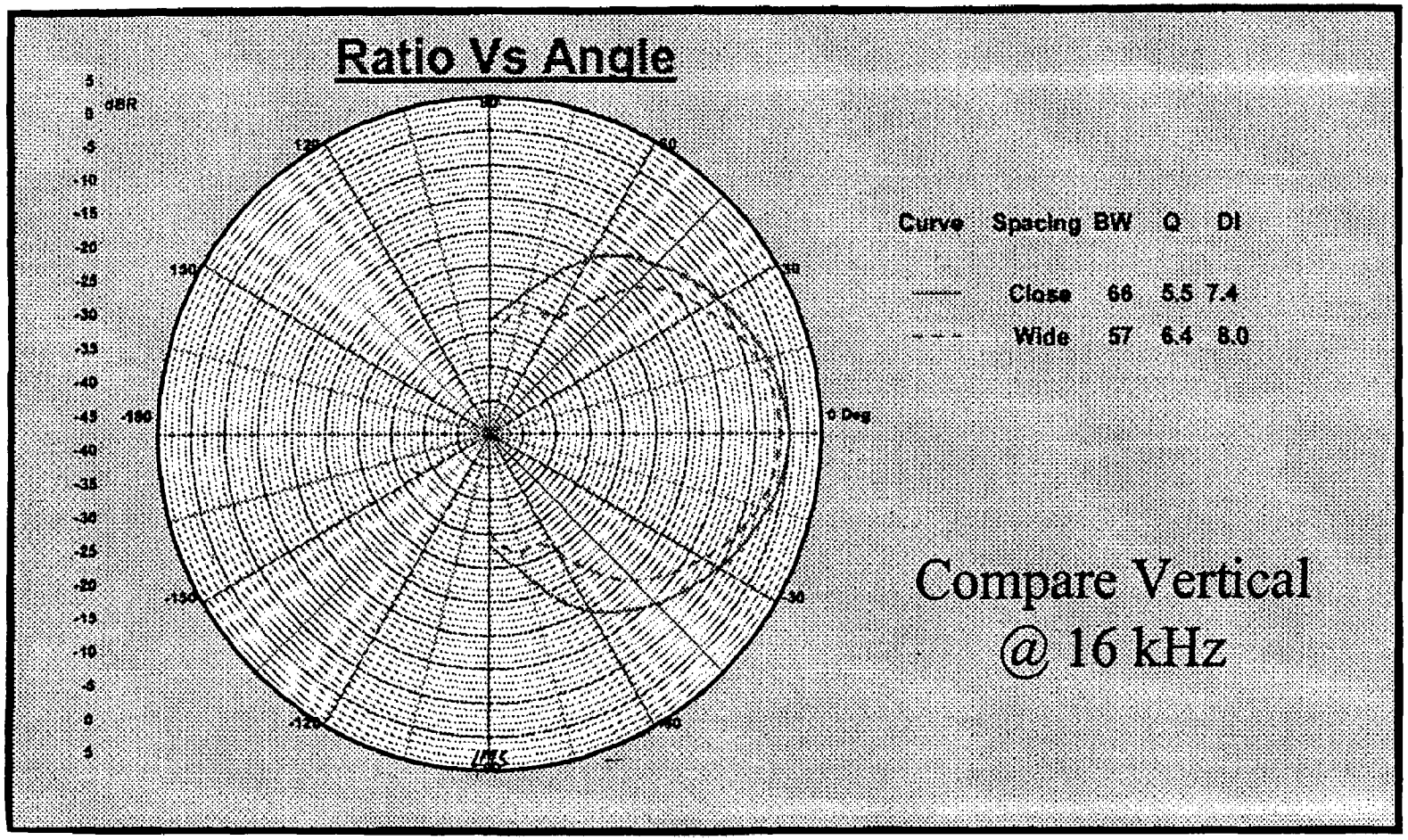
FIG. 12 is a graph comparing tweeters spread apart and tweeters positioned close together in a vertical direction at 16 kHz.
Figure 13:
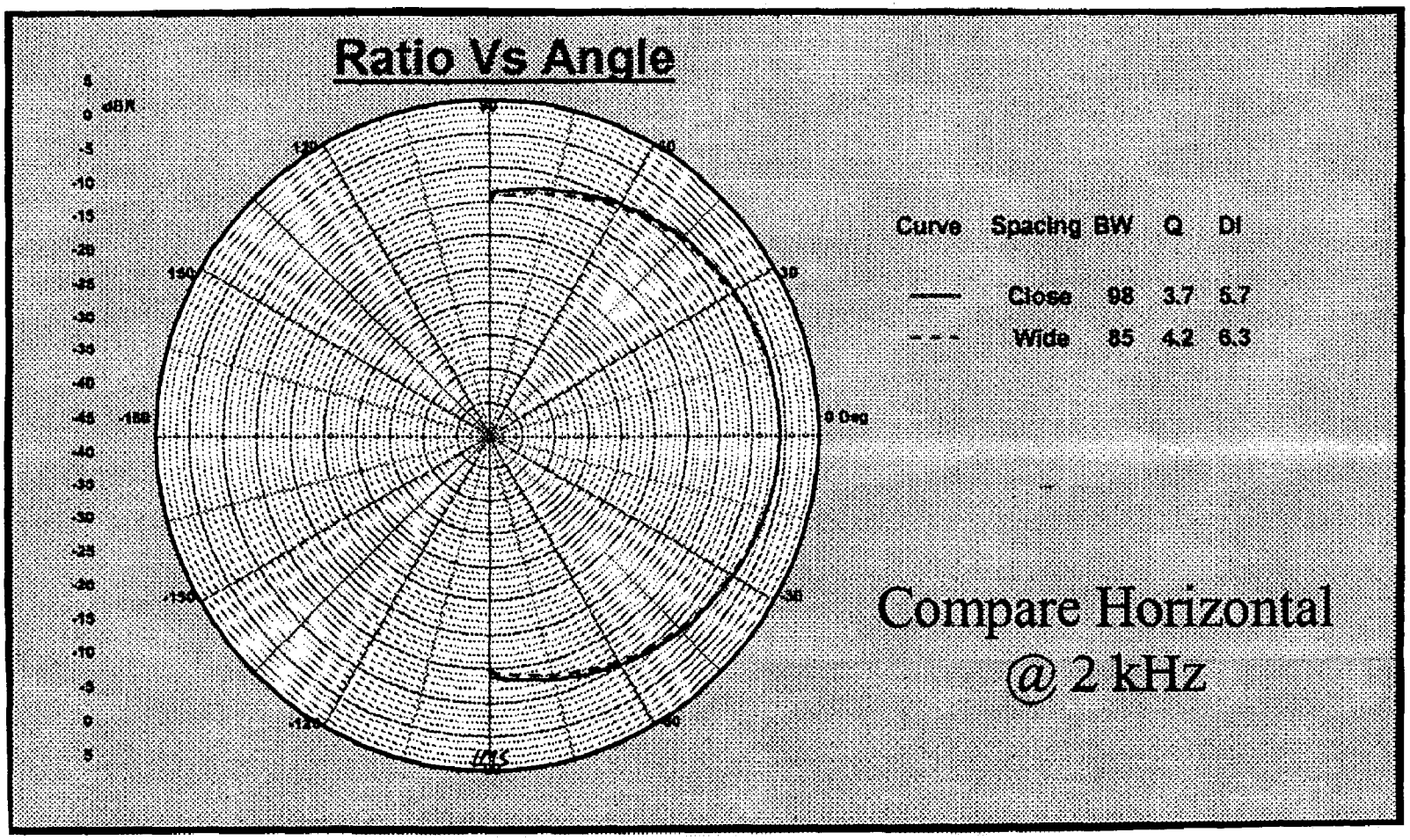
FIG. 13 is a graph comparing tweeters spread apart and tweeters positioned close together in a horizontal direction at 2 kHz.
Figure 14:
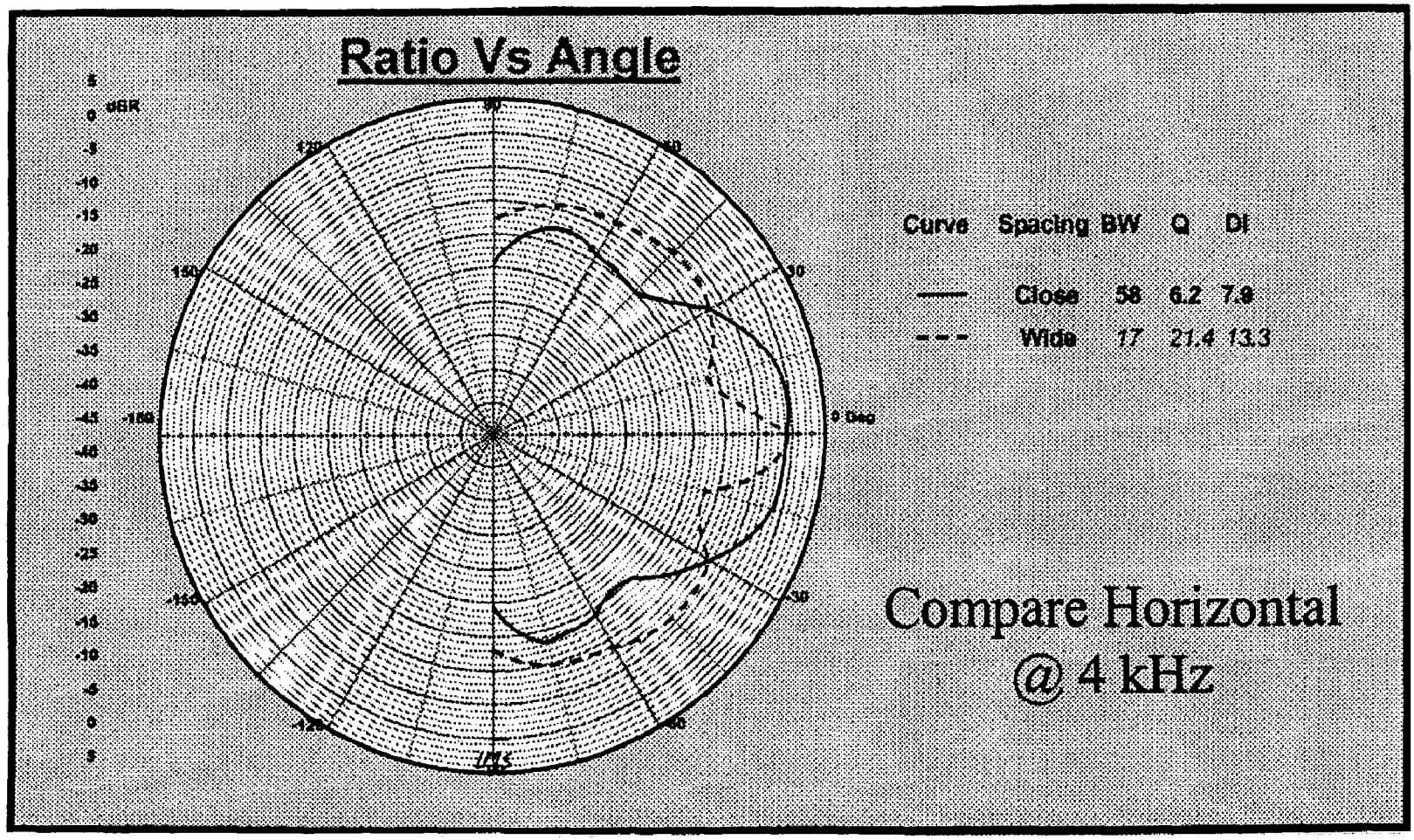
FIG. 14 is a graph comparing tweeters spread apart and tweeters positioned close together in a horizontal direction at 4 kHz.
Figure 15:
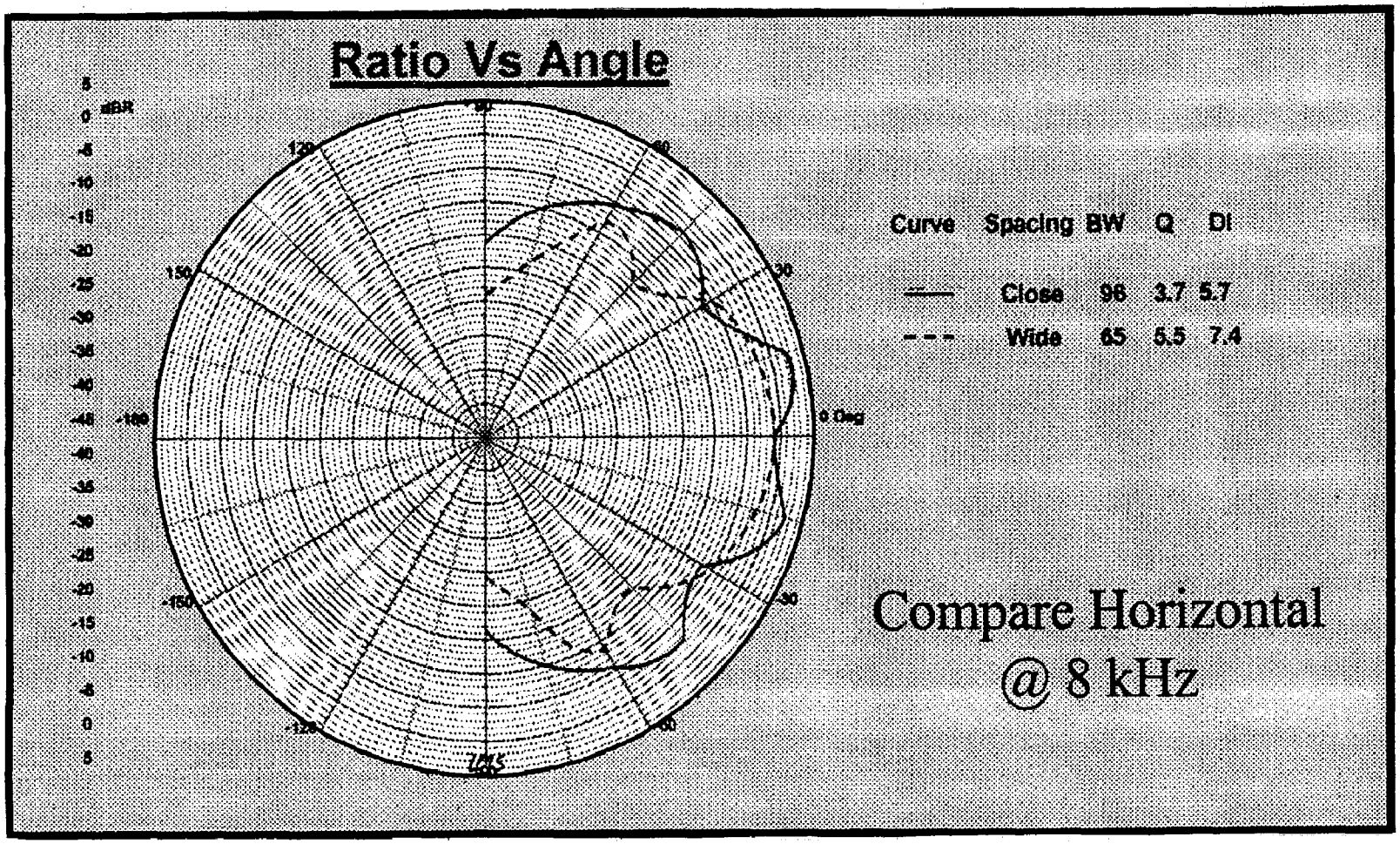
FIG. 15 is a graph comparing tweeters spread apart and tweeters positioned close together in a horizontal direction at 8 kHz.
Figure 16:
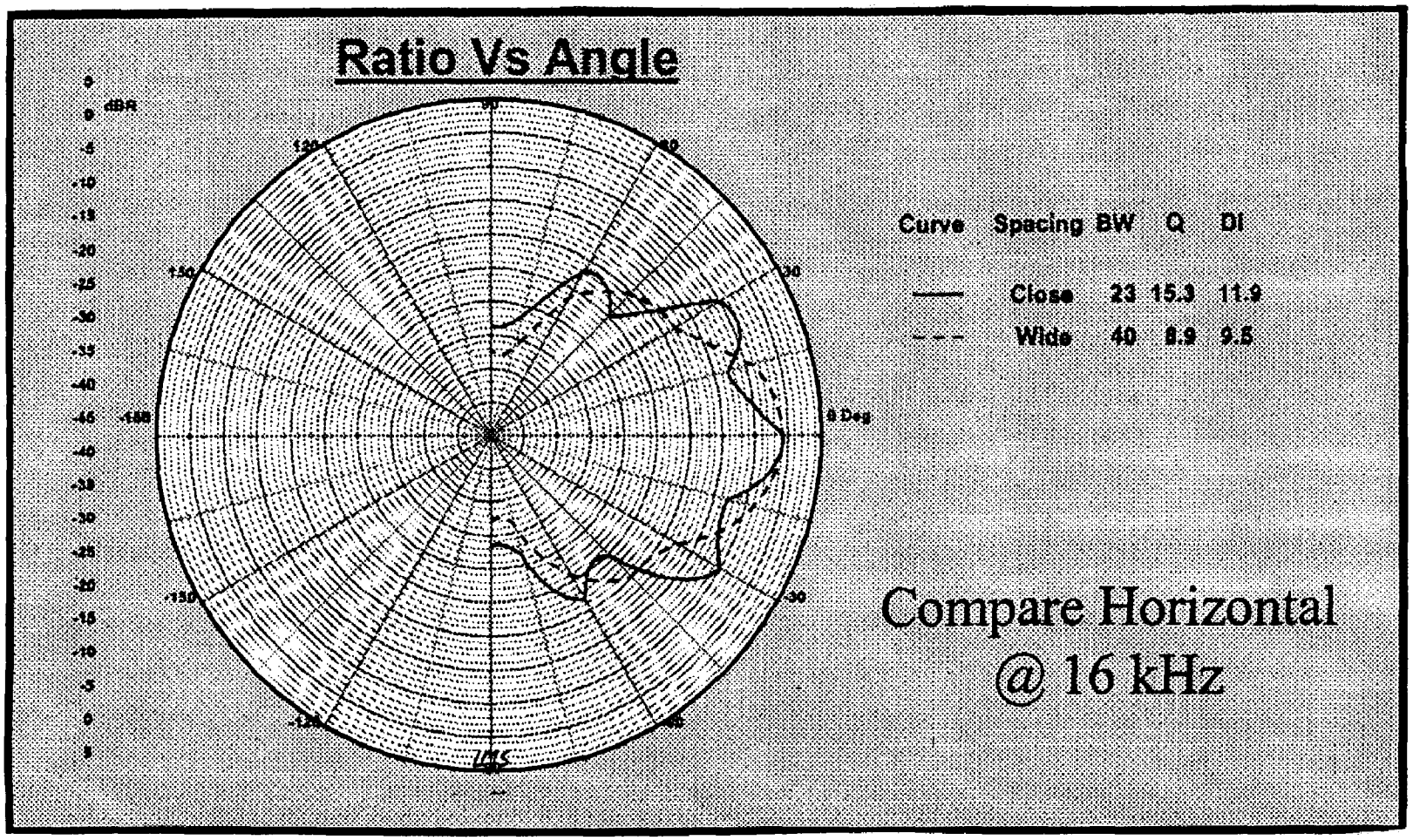
FIG. 16 is a graph comparing tweeters spread apart and tweeters positioned close together in a horizontal direction at 16 kHz.

The polar curve measurements shown in FIGS. 5-16, illustrate that a speaker having the tweeters spaced far apart has a smoother and wider coverage pattern throughout its operating frequencies compared to speakers having the tweeters spaced close together. As seen in the charts wherein the tweeters are spaced far apart, the dispersion angle is wide and smooth, indicating significantly improved stereo imaging. For example, FIGS. 5 and 6 chart the ratio and angle over a variety of frequencies for closely positioned tweeters (FIG. 5) and widely separated tweeters (FIG. 6) in a vertical arrangement. FIGS. 7 and 8 chart the ratio and angle over a variety of frequencies for closely positioned tweeters (FIG. 8) and widely separated tweeters (FIG. 7) in a horizontal arrangement. The widely separated tweeters over a large range of polar frequencies produce a smooth frequency response, compared with the peak and dip response of the closely positioned tweeters. The lobing effect is also reduced significantly in the vertical arrangement.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A stereo speaker system comprising:

a frame generally defined by an outer circumference;

a woofer having an outermost perimeter; and first and second tweeters configured to broadcast in the same general direction as the woofer, wherein the first and second tweeters are positioned at diametrically opposite sides of the frame, and wherein portions of each of the first and second tweeters are disposed inside and outside the outermost perimeter of the woofer as viewed from the front of the woofer.

2. The stereo speaker system of claim 1, wherein the first and second tweeters are located to reduce interference with sound waves emitted by the woofer.

3. The stereo speaker system of claim 1, wherein the first and second tweeters are angularly adjustable.

4. The stereo speaker system of claim 3, wherein the first and second tweeters are angularly adjustable from about 0-50 degrees.

5. The stereo speaker system of claim 1, wherein the woofer comprises a dust dome.

6. The stereo speaker system of claim 1, wherein the speaker system is adapted for mounting in a ceiling.

7. The stereo speaker system of claim 1, wherein the speaker system is adapted for mounting in a wall.

8. A three-driver stereo speaker system comprising:

a woofer driver having a mounting frame generally defining an outermost circumference of the woofer, wherein the mounting frame has an inner surface and an outer surface; and two tweeter drivers, configured to broadcast in the same general direction as the woofer driver each tweeter driver being independently mounted at the inner surface of the mounting frame and in front of the woofer driver so as to expose the center of the woofer as viewed from the front of the woofer driver, wherein portions of each tweeter are disposed inside and outside the outermost circumference of the woofer, and wherein the three-driver stereo speaker system includes no more than three drivers.

9. The stereo speaker of claim 8, wherein the tweeters are angularly adjustable.

10. The stereo speaker system of claim 8, wherein the tweeters are positioned at diametrically opposite ends of the mounting frame.

11. The stereo speaker system of claim 8, wherein the tweeters are not both positioned on a diameter passing through the center of the woofer.

12. The stereo speaker system of claim 11, wherein the tweeters are circumferentially positioned such that a central angle defined by the tweeter positions relative to the center of the woofer is at least 45 degrees.

13. The stereo speaker system of claim 11, wherein the tweeters are positioned between about 45 and 180 degrees of each other with respect to the center of the woofer.

14. A 2-channel stereo speaker for reproducing a stereo signal in an office paging system, comprising:

a ceiling or wall mountable frame;

a woofer driver disposed within the frame and having an outermost perimeter, the woofer driver being configured to broadcast a first frequency range of a first channel and a first frequency range of a second channel, the first channel and the second channel together forming the stereo signal; and first and second tweeters configured to broadcast in the same general direction as the woofer driver, wherein the first and second tweeters are positioned at diametrically opposite sides of the frame, and wherein portions of each of the first and second tweeters are disposed inside and outside the outermost perimeter of the woofer driver as viewed from the front of the woofer driver, and wherein the first tweeter broadcasts a second frequency range of only the first channel, and the second tweeter broadcasts a second frequency range of only the second channel, wherein the second frequency range of the first channel substantially overlaps with the second frequency range of the second channel.

15. A method of making a speaker comprising:

mounting a first tweeter on one side of a woofer so that portions of the first tweeter are disposed inside and outside an outermost perimeter of the woofer as viewed from the front of the woofer; and mounting a second tweeter on an opposite side of the woofer so that a portion of the second tweeter are disposed inside and outside the outermost perimeter of the woofer, as viewed from the front of the woofer wherein the first and second tweeters are disposed so as to expose the center of the woofer as viewed from the front of the woofer, and wherein the first and second tweeters are configured to broadcast in the same general direction as the woofer.

16. An office paging system comprising:

a communication system; and at least one speaker comprising a mounting frame, a woofer driver, and first and second tweeters, configured to broadcast in the same general direction as the woofer driver wherein the first and second tweeters are positioned on the mounting frame, and wherein the first and second tweeters are positioned at diametrically opposite sides of the frame so as to expose the center of the woofer driver as viewed from the front of the woofer driver, and wherein portions of each of the first and second tweeters are disposed inside and outside the outermost perimeter of the woofer driver as viewed from the front of the woofer driver.

17. The office paging system of claim 16, wherein the at least one speaker is ceiling mounted.

18. The office paging system of claim 16, wherein the at least one speaker is wall mounted.

* * * * *